United States Patent [19]

Slattery

[11] 4,429,648

[45] Feb. 7, 1984

[54] STAGGERED NEEDLE BAR FOR TUFTING MACHINES

[75] Inventor: Ian Slattery, Hixson, Tenn.

[73] Assignee: Spencer Wright Industries, Inc., Chattanooga, Tenn.

[21] Appl. No.: 508,137

[22] Filed: Jun. 27, 1983

[51] Int. Cl.[3] ..... D05C 15/12

[52] U.S. Cl. ..... 112/79 R

[58] Field of Search ..... 112/79 R, 79 A, 79 FF, 112/79.5, 221, 226

[56] References Cited

U.S. PATENT DOCUMENTS

| | | | |
|---|---|---|---|
| 3,485,195 | 12/1969 | Torrence | 112/79 R |
| 3,913,505 | 10/1975 | Crumbliss et al. | 112/79 R |
| 3,964,407 | 6/1976 | Ingram | 112/79 R |
| 4,138,956 | 2/1979 | Parsons | 112/79 R |

*Primary Examiner*—H. Hampton Hunter

*Attorney, Agent, or Firm*—Alan Ruderman

[57] ABSTRACT

A fine gauge cut pile tufting machine has a needle mounting apparatus for supporting the needles in two staggered rows with the needles in one row being adjustable in the direction of the row to vary the stagger and compensate for the differential deflection of the hooks cooperating with each row. The needle mounting apparatus includes a needle bar housing carrying needle holding blocks corresponding to each row of needles. The needle mounting blocks are secured to the needle block housing by a bolt passing through an enlarged aperture in the adjustable needle block and secured to the fixed needle block, and adjustable locking members at each end of the needle bar housing for adjustably fixing the longitudinal position of the adjustable needle block.

14 Claims, 3 Drawing Figures

STAGGERED NEEDLE BAR FOR TUFTING MACHINES

BACKGROUND OF THE INVENTION

This invention relates to needle bars for staggered needle tufting machines and more particularly to a staggered needle bar construction permitting longitudinal adjustment of one row of needles relative to the other to permit compensation for hook deflection in very fine gauge tufting machines.

It is known to use a staggered needle bar construction in a tufting machine to produce relatively dense pile tufted fabric. In such construction two parallel rows of needles are mounted transversely or laterally relative to the direction of feed of the backing material and the needles in one of the rows is offset or staggered relative to the needles in the other row. Thus, the needles in one row are disposed laterally half-way intermediate adjacent needles in the other row. Such a construction provides tufts at half the gauge of each row of needles. The staggered needle bar construction has been utilized for both loop pile tufting machines such as illustrated in Webb U.S. Pat. No. 3,492,956, and cut pile tufting machines such as illustrated in Crumbliss, et al U.S. Pat. No. 3,913,505.

When staggering the needles in the needle bar the loopers or hooks which cooperate with the respective needles must be of two types. One set of loopers or hooks have a short bill for cooperating with the needles in the front or rear row and the other set have a long bill for cooperating with the needles in the rear or front row, the disposition of rows being relative to the direction in which the base material is fed, so that loops of yarn presented by the needles are seized by all the loopers or hooks.

In cut pile tufting machines knives cooperate with the respective hooks and act against a face thereof to cut the yarn loops on the hooks. The knives are set against the hooks with sufficient pressure for effective cutting action to occur and deflect the hooks slightly. In machines that produce fine gauge fabrics, e.g. 5/64 inch spacing between longitudinal rows of stitches, and especially 1/16 inch and smaller, the hooks must be extremely thin and relatively substantial deflection results. In machines having a staggered needle bar the longer billed hook deflects further than the shorter billed hook. Conventionally, in staggered needle bar machines the needles in one row are fixed relative to the needles in the other row and no provision for the differential in deflection is possible. Thus, at the time the machine is assembled or when gauge parts are replaced, the positioning of one set of hooks to seize loops from their respective needles may result in the other set of hooks failing to seize loops from their respective needles on every stroke due to the greater deflection of the long billed hooks.

SUMMARY OF THE INVENTION

Consequently, it is a primary object of the present invention to provide a needle mounting construction for a staggered needle tufting machine in which one row of needles may be adjustably positioned off-gauge relative to the other row.

It is another object of the present invention to provide a needle bar for a tufting machine having a pair of rows of needles, the needles in one row being offset relative to the needles in the other row, the needle bar having provision for adjusting the amount of offset between the rows.

It is a further object of the present invention to provide a fine gauge cut pile tufting machine having a pair of staggered rows of needles cooperating with respective long bill and short bill hooks, a needle bar assembly which permits one row of needles to be adjusted relative to the other row to compensate for the greater deflection of the long bill hooks.

Accordingly, the present invention in recognizing the difficulties of conventional staggered needle cut pile tufting machines provides a needle bar having a housing for mounting two rows of needles in separate needle mounting blocks, the needles in one block being staggered relative to the needles in the other block and one of the blocks being adjustable relative to the other block to vary the stagger between the needles in one row and the needles in the other row. Each needle mounting block includes means for permitting the block to be clamped to the needle bar, the means of one of the blocks permitting that block to be moved relative to the other block. In the preferred form of the invention each needle mounting block includes apertures extending transverse to the elongated or longitudinal axis of the needle bar, the apertures being aligned so that a clamping member may secure them to the needle bar, but the aperture in the adjustable block is larger than the clamping member at least in the direction of elongation of the needle bar to permit length-wise variation of its position, while the fixed block is secured to the clamping member and abuts the adjustable block to clamp the latter to the needle bar in the direction transverse to the longitudinal axis of the needle bar. Additionally, the needle bar carries locking means at each end thereof to position and secure the adjustable needle block at the selected position. In the specific embodiment disclosed the clamping member comprises a threaded bolt and the aperture in the fixed holder is tapped for threadedly receiving the bolt which passes through the enlarged aperture in the adjustable needle block, and the locking means comprises adjustable stop members for incrementally positioning the adjustable needle block.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
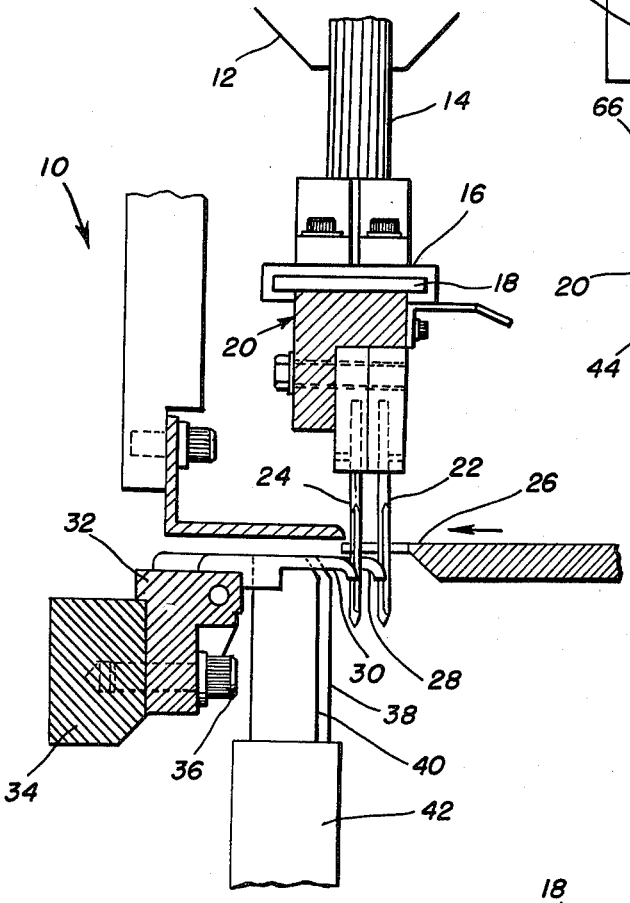
FIG. 1 is an end sectional elevational view in diagrammatic form of a portion of a tufting machine embodying a needle bar constructed in accordance with the principles of the present invention.
Figure 2:
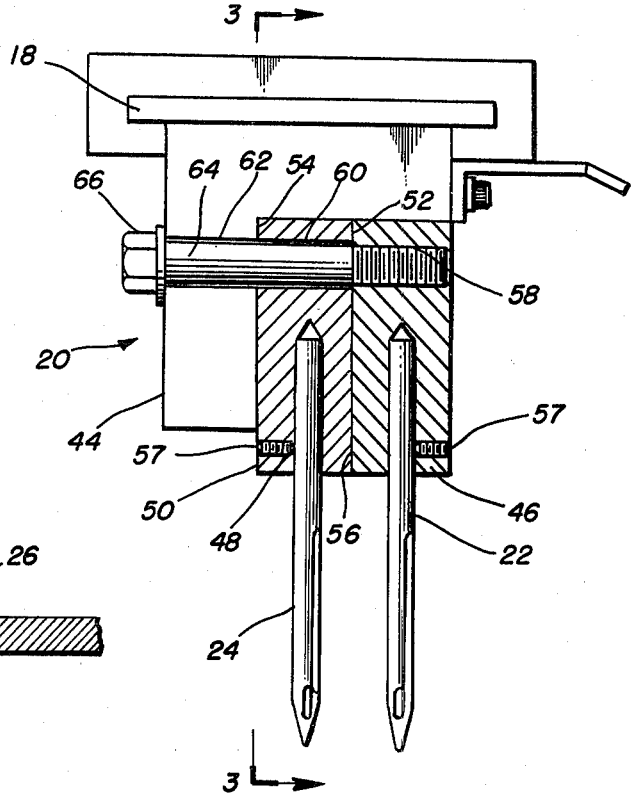
FIG. 2 illustrates the needle bar portion of FIG. 1 on a greatly enlarged scale.

Referring now to the drawings, and particularly to FIG. 1, the relevant portions of a tufting machine 10, are illustrated as including a plurality of bearing housings 12 (only one being illustrated) through each of which a respective push rod 14 is reciprocably driven in conventional manner. Carried at the end of each push rod 14 is a needle bar support foot or carrier 16. The support foot 16 may have a slideway within which a slide plate 18 is slidably received. A needle bar generally indicated at 20 is secured to the plate 18 and thus may be shifted within the slideway and is reciprocably driven vertically by the action of the push rods. The needle bar 20 as hereinafter described carries a plurality of needles 22, 24 in two respective rows, the needles being adapted to penetrate a base material fed over a needle plate 26 by conventional means during each reciprocating stroke of the push rods. The needles 22, 24, in each respective row are staggered relative to the needles in the other row, that is, the needles 22 are offset relative to the needles 24 along the longitudinal direction of the needle bar, which is transverse to the direction of feed of base material through the machine, the latter being illustrated by the arrow. Consequently, as is notoriously well known in the art, each needle 24 inserts a loop of yarn into the base material substantially intermediate the loops inserted by the needles 22.

The machine illustrated is a cut pile tufting machine and mounted in the bed beneath the needle plate 26 is a plurality of front hooks 28 and a plurality of rear hooks 30. The hooks 28 cooperate with the needles 22, and the hooks 30 cooperate with the needles 24 to conventionally seize loops of yarn presented by the respective needles. The hooks 28 and 30 may be mounted in modules having a body member 32 which is secured to a hook mounting bar 34 by screw means 36. The hooks 28 have a longer bill than the hooks 30 so that they extend into cooperative relationship with the needles 22 while the shorter hooks 30 cooperate with the needles 24. The hook mounting bar 34 may be oscillated conventionaly to drive the hooks into cooperative relationship with the respective needles. The hooks 28, 30 also cooperate with respective knives 38, 40 which may be carried by common knife blocks 42 and oscillated in timed relationship with the oscillation of the hooks for coacting against a face of the respective hooks in scissors-like manner for cutting loops of yarn on the respective hooks to form cut pile.

To obtain effective cutting action of the knives 38, 40 against the adjacent surface of the respective hooks 28, 30, the knives are set against the hooks with a substantial pressure which results in a certain amount of hook deflection. In very fine gauge tufting machines, the hooks 28, 30 are extremely thin and a greater deflection results than in the case of courser gauge machines. In a staggered needle machine, as illustrated, the long billed hooks 28 deflect further than the short billed hooks 30. As aforesaid, difficulties have occurred with prior art constructions since the hooks and needles are on the exact gauge, i.e., the spacing between the needles 22 and the needles 24 forming the adjacent rows of stitches in the base material have been the same as the spacing between the cooperating hooks 28, 30. Thus, since the hooks 28 deflect further than the hooks 30, the proper setting of one set of hooks to seize loops from their cooperating needles presents difficulties in the seizing of loops of the other set of hooks from their cooperating needles.

To alleviate the aforesaid difficultes the present invention provides a needle mounting construction on which one row of needles may be adjustably mounted off-gauge relative to the other row of needles and their respective hooks. Thus, although either row of needles may be adjustably mounted in the needle bar, the invention is described with reference to the rear row of needles 24 as being the adjustable needles. The needle bar 20 comprises a housing 44 which as illustrated may be one or more elongated longitudinally extending L-shaped sections extending transversely across the machine. The sectional configuration of the housing may be of any other convenient shape such as an inverted U without departing from the invention. Disposed in the step portion of each housing 44 are a pair of substantially rectangular needle holding blocks 46, 48, the block 46 carrying the needles 22 and the block 48 carrying the needles 24. The holding block 46 includes a pair of spaced apart substantially planar side surfaces 50, 52, the surface 50 being adapted to abut a substantially planar surface 54 of the needle bar housing and the surface 52 being adapted to abut a similar substantially planar side surface 56 of the holding block 48. Thus, the surfaces 50–56 are reference surfaces for providing acurate positioning of the holding blocks 46, 48 in the vertical and in the front to rear directions when the holding blocks are mounted as hereinafter described. The needles 22, 24 are disposed vertically within bores in the respective blocks intermediate the respective side surfaces and secured by conventional securing means such as set screws 57.

Disposed through each needle block 46, 48 is at least one bore 58, 60 extending through the respective block in the direction transverse to the longitudinal direction of the needle bar, and similar bores 62 extend through the downwardly depending leg of the needle bar housing 44. The bores 60 and 62 may be of substantially the same size, the bore 60 being of a size for freely receiving the stem 64 of a bolt 66. The bore 58, which is smaller than the bore 60, is tapped for securely receiving the threaded end of the stem 64 when the bores 58–62 are in alignment. Whe so aligned the needles 22 and 24 are staggered as aforesaid. However, since the bore 60 is larger than the stem 64 the needle holding block 48 may be moved slightly relative to the block 46 to vary the stagger of the needles slightly relative to the on-gauge stagger prior to securely tightening the bolts 66 into the needle block 46.

Figure 3:
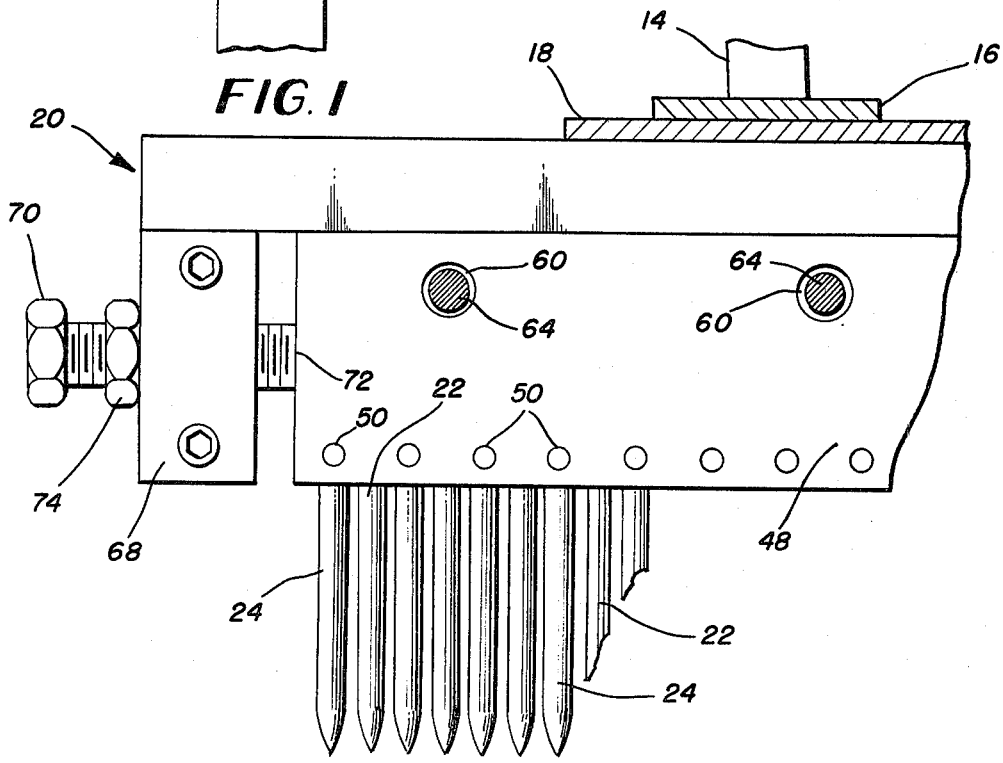
FIG. 3 is a sectional view taken longitudinally through the needle bar substantially along line 3—of FIG. 2.

At each end of the needle bar 20, the housing 44 is extended relative to the needle holders 46, 48 and includes a downwardly depending end member 68 at least adjacent the needle holder 48 and spaced slightly therefrom as illustrated in FIG. 3. A bore (not illustrated) is tapped through the end of each member 68 for receiving the threaded portion of a bolt 70 at a disposition so that the end 72 of the bolt is adapted to engage the respective end of the needle holding block 48. The end 72 of the bolt 70 acts as an abutment stop for adjusting the disposition of the needle block 48 and lock nuts 74 are provided for locking the bolts 70 and thus the needle holder 48 at the desired disposition longitudinally of the needle bar. Thus, to correct for the differential deflection of the hooks 28, 30, the bolts 66 and the nuts 74 are first loosened, and the bolt 70 is loosened slightly at one end of the needle bar while at the other end the bolt 70 is tightened to shift the adjustable needle holding block 48 slightly in the desired direction relative to the fixed needle holding block 46. The lock nuts 74 and the bolts 66 are thereafter tightened to lock the needle holding blocks securely in the needle bar.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine, needle mounting apparatus for supporting a plurality of needles in two longitudinal rows extending transversely across the machine, the needles in one row being offset longitudinally relative to the needles in the other row to provide a stagger, the amount of offset being adjustable, said apparatus comprising a needle bar housing having a substantially planar reference surface reciprocably carried in said machine, a first elongated needle holding block corresponding to said one row and a second elongated needle holding block corresponding to said other row, said first block having a pair of spaced longitudinally extending substantially planar reference surfaces, said second block having a pair of spaced longitudinally extending surfaces, at least one of said surfaces of said second block being a substantially planar reference surface, means for securing a first plurality of needles intermediate the surfaces of said first block and a second plurality of needles intermediate the surfaces of said second block, fastening means for clamping said blocks to said needle bar housing with the reference surfaces of said first block abutting the respective reference surfaces of said needle bar housing and of said second block and with said first needles offset substantially intermediate said second needles, said fastening means including means for permitting said first block to be positioned relative to said second block and to said needle bar housing for adjusting the stagger of said first needles relative to said second needles so that the first block may be adjusted finely and secured to said needle bar housing and to said second block.

2. In a tufting machine, needle mounting apparatus as recited in claim 1, wherein said fastening means includes securing means for clamping said blocks against movement transversely to the longitudinal direction of said rows, and locking means for clamping said blocks longitudinally in said rows.

3. In a tufting machine, needle mounting apparatus as recited in claim 2, wherein said locking means comprises an end member at each end of said needle bar housing spaced from a respective end of said first holding block, stop means fastened to each end member for abutting a respective end of said first holding block, and means for adjusting the longitudinal dispostion of said stop means.

4. In a tufting machine, needle mounting apparatus as recited in claim 2, wherein said securing means comprises a bore extending through each of said needle bar housing, said first block and said second block, said bores being aligned, a bolt having a head abutting one of said needle bar housing and said second block, and a threaded end extending through said bores and threadedly received in the bore of the other of said housing and said second block, the bore of said first block being larger than the diameter of said bolt at least in the direction for permitting the first block to be moved longitudinally before said bolt is tightened and said locking means is clamped.

5. In a tufting machine, needle mounting apparatus as recited in claim 4, wherein said locking means comprises an end member at each end of said needle bar housing spaced from a respective end of said first holding block, stop means fastened to each end member for abutting a respective end of said first holding block, and means for adjusting the longitudinal disposition of said stop means.

6. In a tufting machine, needle mounting apparatus as recited in claim 2, wherein said locking means comprises an end member at each end of said needle bar housing spaced from a respective end of said first holding block, a threaded member extending through each end member and abutting the respective end of said first block, and a lock nut for securing each threaded member to the respective end member at selective longitudinal dispositions of the threaded members.

7. In a tufting machine, needle mounting apparatus as recited in claim 6, wherein said securing means comrpises a bore extending through each of said needle bar housing, said first block and said second block, a bolt having a head abutting one of said needle bar housing and said second block, and a threaded end extending through said bores and threadedly received in the bore of the other of said housing and said second block, the bore of said first block being larger than the diameter of said bolt at least in th direction for permitting the first block to be moved longitudinally before said bolt is tightened and said lock nuts are secured.

8. A needle bar for supporting a plurality of needles in two longitudinal rows extending transversely across a tufting machine, the needles in one row being offset longitudinally relative to the needles in the other row to provide a stagger, the amount of offset being adjustable, said needle bar comprising a needle bar housing having a substantially planar reference surface reciprocably carried in said machine, a first elongated needle holding block corresponding to said one row and a second elongated needle holding block corresponding to said row, said first block having a pair of spaced longitudinally extending substantially planar reference surfacea, said second block having a pair of spaced longitudinally extending surfaces, at least one of said surfaces of said second block being a substantially planar reference surface, means for securing a first plurality of needles intermediate the surfaces of said first block and a second plurality of needles intermediate the surfaces of said second block, fastening means for clamping said blocks to said needle bar housing with the reference surfaces of said first block abutting the respective reference surfaces of said needle bar housing and of said second block and with said first needles offset substantially intermediate said second needles, said fastening means including means for permitting said first block to be positioned relative to said second block and to said needle bar housing for adjusting the stagger of said first needles relative to said second needles so that the first block may be adjusted finely and secured to said needle bar housing and to said second block.

9. A needle bar as recited in claim 8, wherein said fastening means includes securing means for clamping said blocks against movement transversely to the longitudinal direction of said rows, and locking means for clamping said blocks longitudinally in said rows.

10. A needle bar as recited in claim 9, wherein said locking means comprises an end member at each end of said needle bar housing spaced from a respective end of said first holding block, stop means fastened to each end member for abutting a respective end of said first holding block, and means for adjusting the longitudinal disposition of said stop means.

11. A needle bar as recited in claim 9, wherein said securing means comprises a bore extending through each of said needle bar housing, said first block and said second block, said bores being aligned, a bolt having a head abutting one of said needle bar housing and said second block, and a threaded end extending through said bores and threadedly received in the bore of the other of said housing and said second block, the bore of said first block being larger than the diameter of said bolt at least in the direction for permitting the first block to be moved longitudinally before said bolt is tightened and said locking means is clamped.

12. A needle bar as recited in claim 11, wherein said locking means comprises an end member at each end of said needle bar housing spaced from a respective end of said first holding block, stop means fastened to each end member for abutting a respective end of said first holding block, and means for adjusting the longitudinal disposition of said stop means.

13. A needle bar as recited in claim 9, wherein said locking means comprises an end member at each end of said needle bar housing spaced from a respective end of said first holding block, a threaded member extending through each end member and abutting the respective end of said first block, and a lock nut for securing each threaded member to the respective end member at selective longitudinal dispositions of the threaded members.

14. A needle bar as recited in claim 13, wherein said securing means comprises a bore extending through each of said needle bar housing, said first block and said second block, a bolt having a head abutting one of said needle bar housing and said second block, and a threaded end extending through said bores and threadedly received in the bore of the other of said housing and said second block, the bore of said first block being larger than the diameter of said bolt at least in the direction for permitting the first block to be moved longitudinally before said bolt is tightened and said lock nuts are secured.

* * * * *